US006192638B1

(12) United States Patent
Wang

(10) Patent No.: US 6,192,638 B1
(45) Date of Patent: Feb. 27, 2001

(54) KNOCKDOWN DOORFRAME AND BUILDING METHOD THEREOF

(76) Inventor: Guo-Chi Wang, 5 Floor, No. 19, Lane 85, King-Hua Street, Panchiao, Taipei Hsien (TW)

( * ) Notice: Subject to any disclaimer, the term of this patent is extended or adjusted under 35 U.S.C. 154(b) by 0 days.

(21) Appl. No.: 09/200,508

(22) Filed: Nov. 26, 1998

(51) Int. Cl.[7] ..... E04B 1/12

(52) U.S. Cl. ..... 52/213; 52/204.1; 52/215; 52/656.4; 52/211; 49/504

(58) Field of Search ..... 52/204.1, 205–207, 52/210–217, 656.2, 656.4, 656.5, 656.6, 656.7, 730.3, 730.5, 730.6, 715, 717.01; 44/504, 505

(56) References Cited

U.S. PATENT DOCUMENTS

| | | | | |
|---|---|---|---|---|
| 1,271,210 | * | 7/1918 | Otte | 49/504 |
| 2,541,871 | * | 2/1951 | Heijmer et al. | 49/505 X |
| 2,818,947 | * | 1/1958 | Goldberg | 52/215 X |
| 3,019,868 | * | 2/1962 | Truman et al. | 49/504 |
| 3,103,263 | * | 9/1963 | Leeser | 52/213 |
| 3,250,049 | * | 5/1966 | Sklar | 52/213 X |
| 3,320,705 | * | 5/1967 | Downing, Jr. | 49/504 X |
| 3,385,004 | * | 5/1968 | Oehler et al. | 49/504 X |
| 3,769,773 | * | 11/1973 | Mochizuki | 52/213 X |
| 4,014,146 | * | 3/1977 | DiMascio et al. | 52/211 |
| 4,223,494 | * | 9/1980 | Wendt | 52/211 |
| 4,281,480 | * | 8/1981 | Wendt | 49/504 |
| 4,510,722 | * | 4/1985 | van Wieringen | 52/213 |
| 5,038,538 | * | 8/1991 | Rozon | 52/213 |
| 5,575,123 | * | 11/1996 | Adams | 52/212 |
| 5,669,198 | * | 9/1997 | Ruff | 49/504 |
| 5,771,644 | * | 6/1998 | Kidd | 52/213 |
| 5,974,745 | * | 11/1999 | Barr | 52/212 |

FOREIGN PATENT DOCUMENTS

| | | | | |
|---|---|---|---|---|
| 130047 | * | 11/1950 | (NL) | 52/215 |

* cited by examiner

*Primary Examiner*—Richard Chilcot

(57) ABSTRACT

A knockdown doorframe includes: a pair of jambs (1) respectively secured on a right and left vertical side wall (V) of a door entrance or doorway (O) by means of brackets (2) longitudinally pre-fixed on the right and left vertical side walls (V), each jamb (1) having a waterproof pad (3) cushioned on a bottom of the jamb (1), a lintel (4) horizontally secured on the top portion of each jamb (1) adjacent to a horizontal top wall (H) of the doorway to form an inversed U-shaped doorframe, and each jamb (1) and lintel (4) having a covering plate **(5, 5*a*)** covered thereon for shielding an aperture (A) between the doorframe and the wall (V, H) of the doorway (O) for decorative purpose.

11 Claims, 9 Drawing Sheets

KNOCKDOWN DOORFRAME AND BUILDING METHOD THEREOF

BACKGROUND OF THE INVENTION

When building a conventional doorframe for pivotally installing a door within the doorframe, the doorframe should be pre-erected in a construction site and then, the concrete is formed or the bricks are stacked around the doorframe to fix the doorframe with the concrete or brick wall.

However, it has the following drawbacks:

1. The doorframe is pre-erected in the construction site by strut or brace or linkage, which may obstruct the construction or material handling by the workers.

2. The doorframe pre-erected in the site may be easily scratched, impacted, worn, twisted, deformed or damaged during the construction of the building or house.

3. The doorframe is supplied as a fixed doorframe set already fabricated in a factory, thereby lacking of diversity, flexibility or adjustment for the construction.

The present inventor has found the drawbacks of a conventional doorframe and invented the present knockdown doorframe and its building method.

SUMMARY OF THE INVENTION

The object of the present invention is to provide a knockdown doorframe including: a pair of jambs (1) respectively secured on a right and left vertical side wall (V) of a door entrance or doorway (O) by means of brackets (2) longitudinally pre-fixed on the right and left vertical side walls (V), each jamb (1) having a waterproof pad (3) cushioned on a bottom of the jamb (1), a lintel (4) horizontally secured on the top portion of each jamb (1) adjacent to a horizontal top wall (H) of the doorway to form an inversed U-shaped doorframe, and each jamb (1) and lintel (4) having a covering plate (5, 5*a*) covered thereon for shielding an aperture (A) between the doorframe and the wall (V, H) of the doorway (O) for decorative purpose.

DETAILED DESCRIPTION

Figure 1:
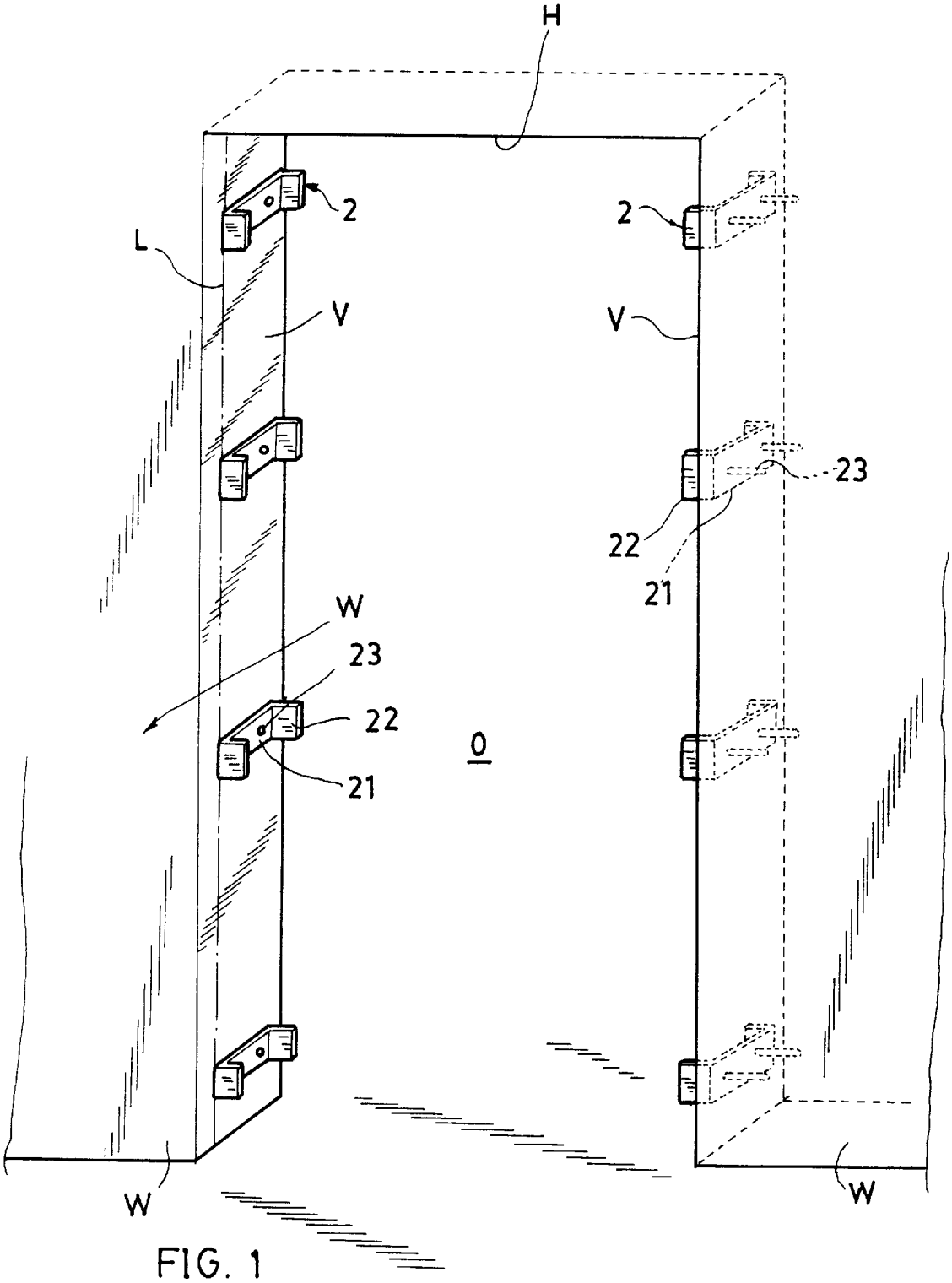
FIG. 1 is an illustration showing a first step for building the knockdown doorframe of the present invention.
Figure 2:
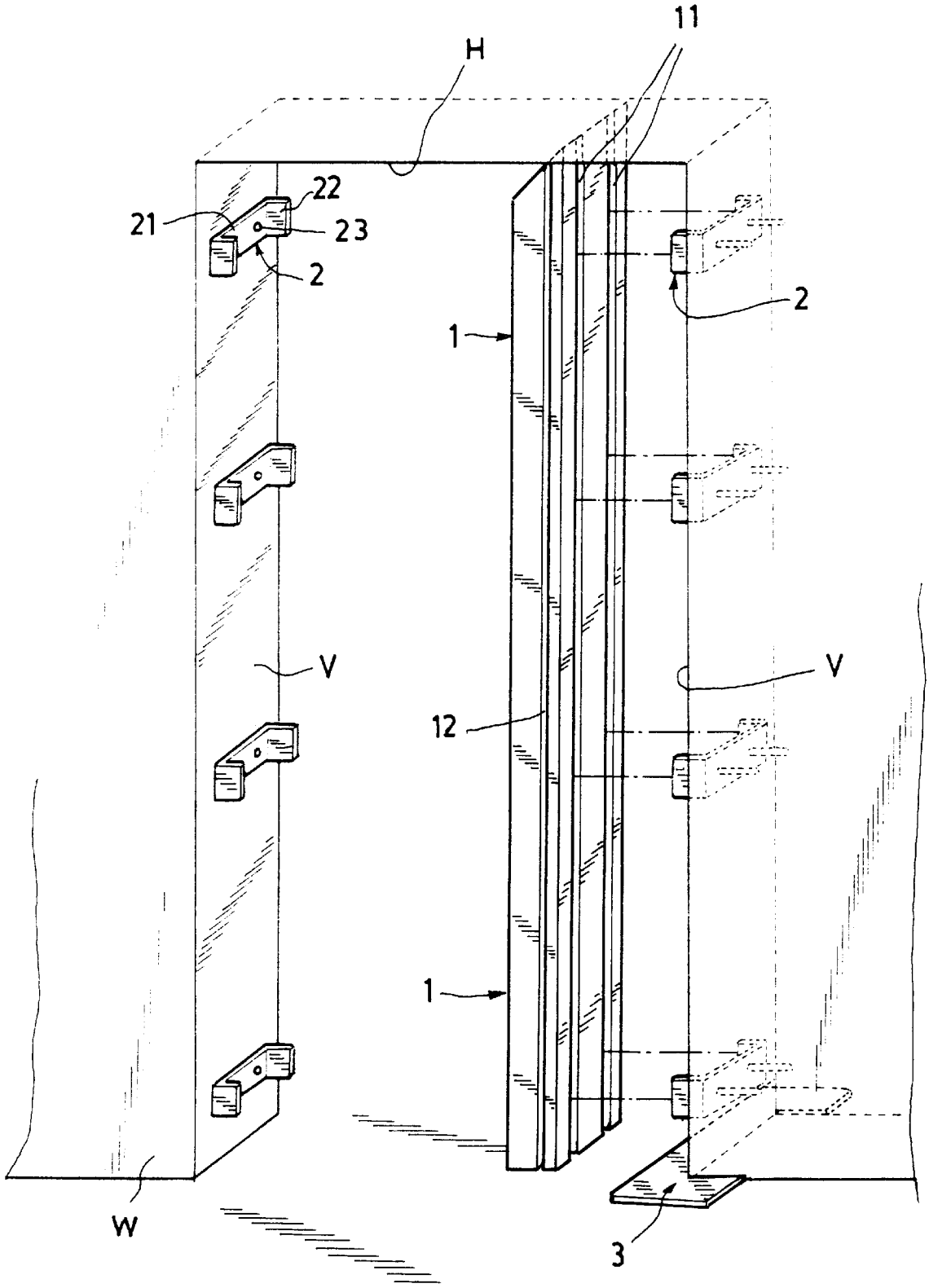
FIG. 2 shows the installation of a right jamb of the present invention.
Figure 3:
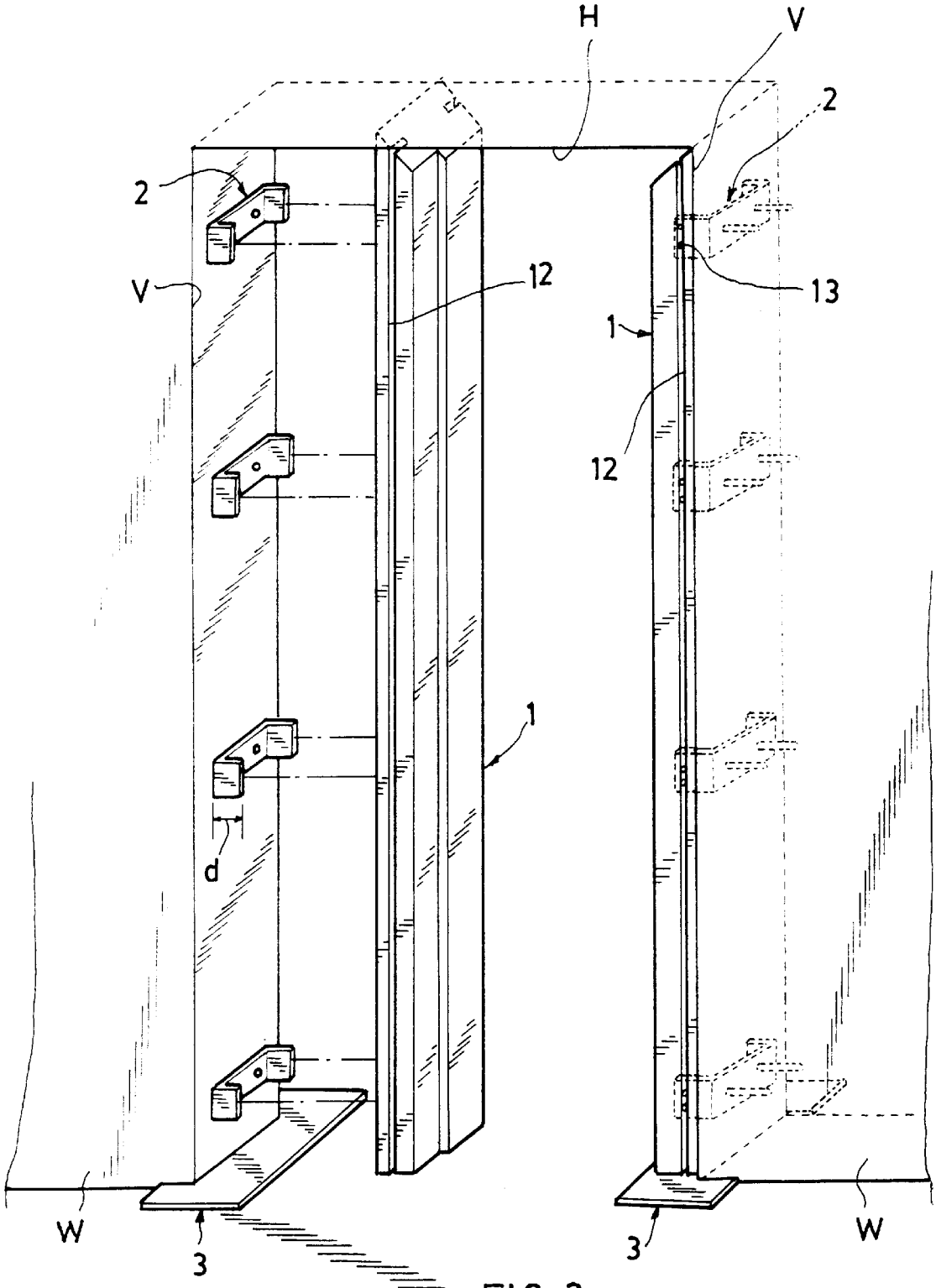
FIG. 3 shows the installation of a left jamb of the present invention.
Figure 4:
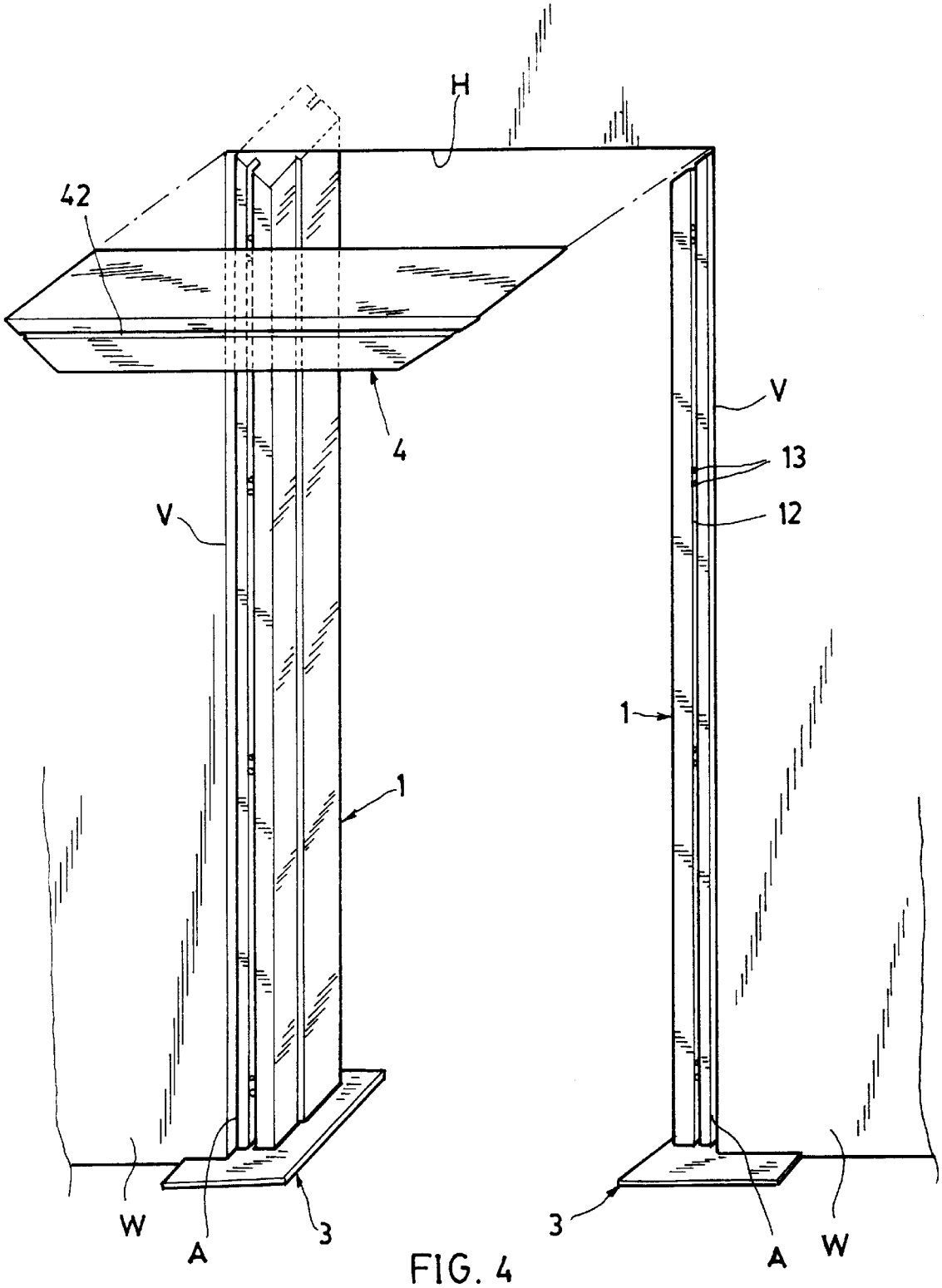
FIG. 4 shows the installation of the lintel of the present invention.
Figure 5:
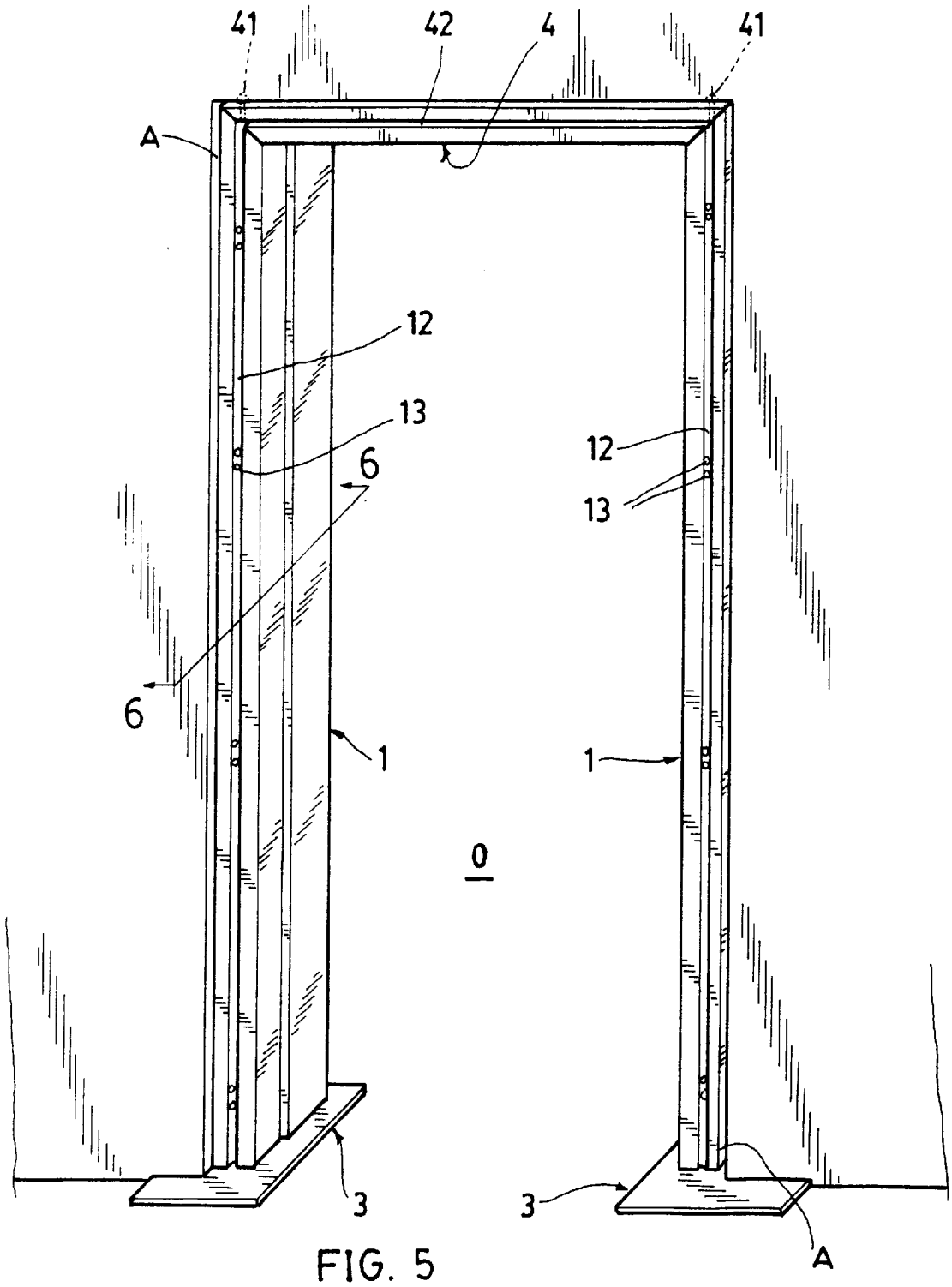
FIG. 5 shows the fixation of the doorframe in the doorway in accordance with the present invention.

As shown in FIGS. 1~8, the present invention comprises: a pair of jambs 1 respectively fixed on a left and right vertical side wall V of a doorway O by means of a plurality of brackets 2 pre-fixed on the walls V, a pair of waterproof pads 3, which may be made of waterproof elastomer, rubber or plastic materials, each pad 3 cushioned on a bottom of each jamb 1 for cushioning purpose, a lintel 4 horizontally fixed on a top portion of each jamb 1 adjacent to a horizontal top wall H of the doorway to form an inversed U-shaped doorframe, and two vertical covering plates 5 covering the two jambs 1, 1 and a horizontal covering plate 5*a* covering the lintel 4 for shielding the apertures A between the doorframe (1, 4) and the walls (V, H).

Each jamb 1 includes: at least one or a pair of back grooves 11 longitudinally juxtapositionally recessed in a back portion of the jamb 1, with each back groove 11 slidably engageable with the brackets 2 pre-fixed on the vertical side wall V; and a pair of surface grooves 12 respectively longitudinally recessed in a front surface portion and a rear surface portion of each jamb 1 for inserting a plurality of self-tapping screws or bolts 13 through the surface groove 12 for securing the jamb 1 with the brackets 2 fixed on the wall V, with each surface groove 12 embedded with a vertical covering plate 5 therein.

Each bracket 2 includes: a base portion 21 fixed on the vertical side wall V of a construction wall W by fixing screws, nails or expansion bolts 23, and at least one or two plate extensions 22 protruding outwardly (at distance "d") from opposite ends of the base portion 21 to be perpendicular to the base portion 21 to form a generally U-shaped bracket, with each plate extension 22 insertable into and engageable with each back groove 11 longitudinally recessed in a back portion of the jamb 1.

The lintel 4 is horizontally secured on a top portion of each jamb 1 by fixing nails or screws 41 and is formed with a pair of surface grooves 42 horizontally recessed in a front and a rear surface portion of the lintel 4, with each surface groove 42 embedded with a horizontal covering plate 5*a* therein.

The vertical covering plate 5 includes an embedding end portion 51 insertable into and engageable with each surface groove 12 recessed in the jamb 1, and a bonding end portion 52 opposite to the embedding end portion 51 to be firmly secured on the construction wall W including concrete, brick or metallic wall contiguous to the vertical side wall V by adhesive or by other joining methods.

The horizontal covering plate 5*a* includes an embedding end portion (not shown) insertable into and engageable with each surface groove 42 recessed in the lintel 4, and a bonding end portion (not shown) opposite to the embedding end portion to be firmly secured on the construction wall W including concrete, brick or metallic wall contiguous to the horizontal top wall H by adhesive or by other joining methods.

Adhesive such as silicon adhesive S may be provided for bonding or sealing purpose when fixing the covering plate 5, 5*a* on the wall W or on the jamb 1 or lintel 4.

Figure 7:
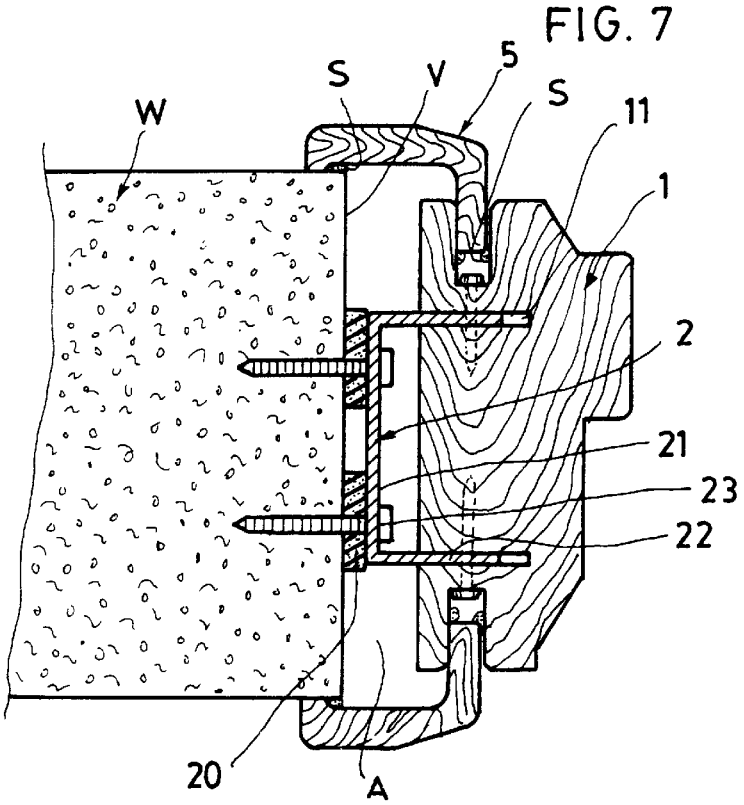
FIG. 7 shows an insertion of packing member within the jamb according to the present invention.

If the aperture A is too wide as shown in FIG. 7, a packing member 20 may be packed between the bracket 2 and the vertical side wall V. After covering the covering plate 5 on the jamb 1 and the wall W, the aperture A will be shielded for a smooth decorative appearance thereof.

Figure 8:
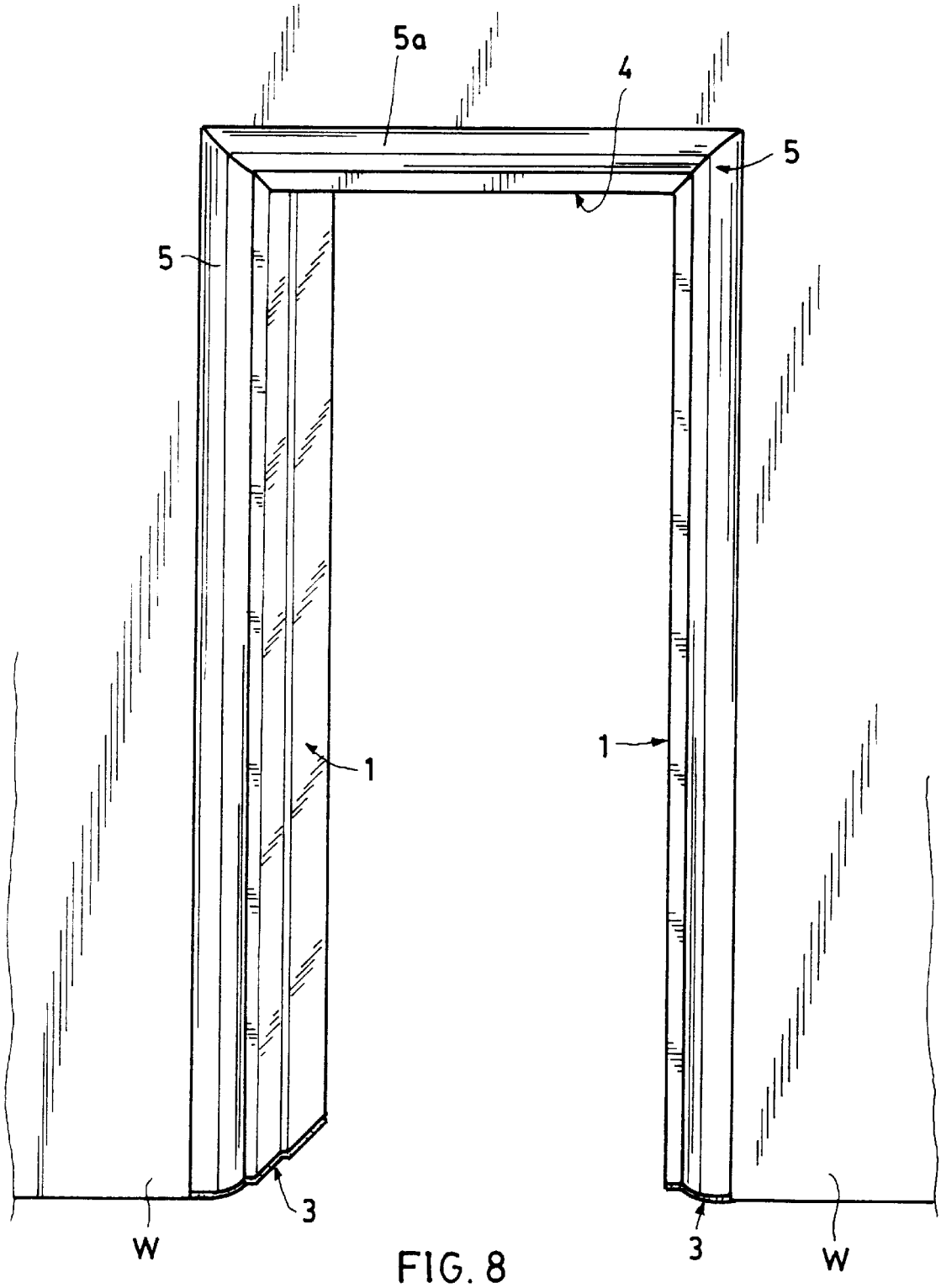
FIG. 8 is an illustration of the doorframe covered with covering plates in accordance with the present invention.

The door D is then pivotally secured to the doorframe by hinge G. The covering plates 5, 5*a* may be formed with decorative features thereon for enhancing the ornamental meaning. The bottom pad 3 may be severed, finished and bonded with adhesive as shown in FIG. 8 for a beautiful appearance thereof.

For fine protection purpose, a fire retarding agent or fire retarding sealant may be incorporated into the aperture between the doorframe and the walls V, H of the construction wall W. For preventing noise pollution, a noise insulating material may also be inserted into the aperture between the doorframe of the present invention and its nearby wall W.

The material for making the covering plate 5, 5*a* may be the same material as that of the jamb 1 and lintel 4, such as made of wood or wood-surfaced materials or any other suitable materials.

Figure 6:
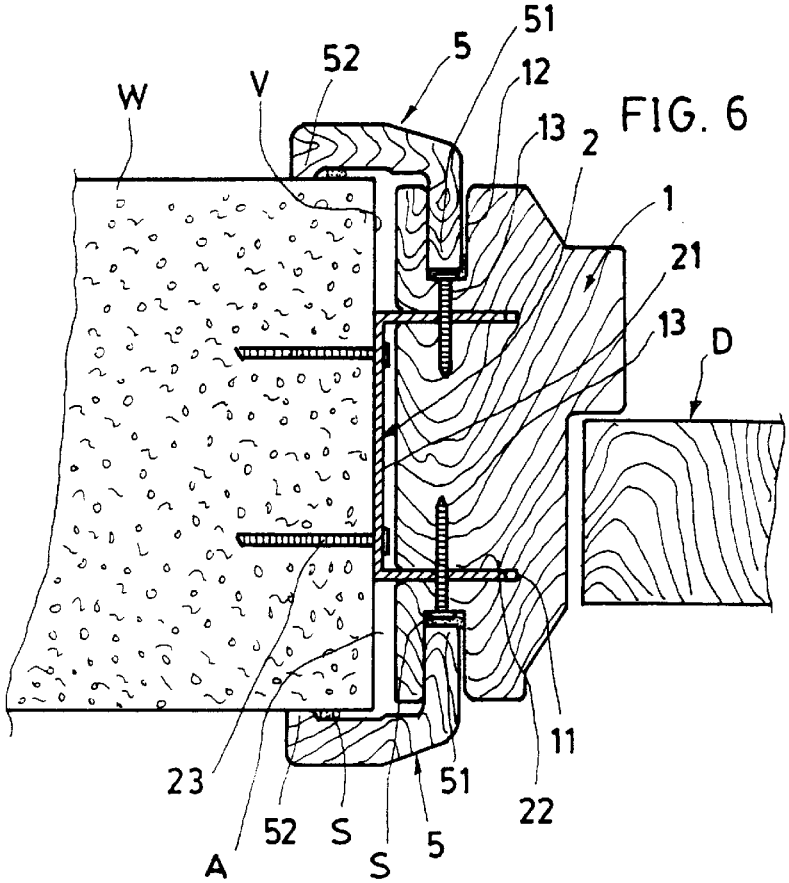
FIG. 6 shows a cross sectional drawing of a jamb when viewed from 6—6 direction of FIG. 5.

The present invention also comprises the method for installing the doorframe on a construction wall, including the following procedures:

1. Calibrating, aligning, marking and determining a plurality of locations on a right and a left vertical side wall V within a doorway O of a built construction wall W for installing the two jambs 1, 1 on the right and left vertical side walls V of the construction wall W with respect to the dimension and specification of the doorframe (For instance, to mark a vertical line L on the side wall corresponding to the jamb 1 as shown in FIG. 1);
2. Fixing a plurality of brackets 2 on the vertical side walls V on the locations as pre-determined on the vertical side walls;
3. Slightly moving each jamb 1 either horizontally or vertically on the brackets 2 by slidably engaging the back grooves 11 in the jamb 1 with the plate extensions 22 formed on the brackets 2 until matching with the specification or dimension of the doorframe to be fixed within the doorway O;
4. Cushioning each jamb 1 with a waterproof pad 3 on a bottom of the jamb 1;
5. Fixing a lintel 4 on a top portion of each jamb 1 to horizontally link the lintel 4, adjacent to a horizontal top wall H of the doorway, with the two jambs 1 to form an inversed U-shaped doorframe; and fastening the jambs 1 on the vertical side walls V after adjustably moving the jambs 1 on the brackets 2 to a desired position;
6. Covering each jamb 1 with each vertical covering plate 5 for shielding an aperture A between each jamb 1 with the vertical side wall V; and covering the lintel 4 with a horizontal covering plate 5*a* for shielding an aperture between the lintel 4 and the horizontal top wall H of the doorway O (as shown in FIGS. 6, 7, 8).

By the way, a doorframe of the present invention can be built with the following advantages superior to a conventional doorframe:

1. There is no need to pre-fit the doorframe for filling concrete or for stacking bricks around the doorframe. The construction wall W with doorway O may be built first, while the doorframe of the present invention can be installed within the doorway afterwards.
2. The elements in construction of the doorframe including jambs 1, lintel 4 and covering plates 5, 5*a* may be pre-fabricated by mass production in a factory for greatly reducing the production cost. All the elements will then be conveniently assembled and installed as a doorframe in the construction site.
3. The doorframe is installed after finishing the construction wall of a building, thereby minimizing the chance of abrasion or damage on the doorframe.
4. The jambs 1 may be slightly adjusted on the brackets 2 before being deadly fixed, providing a flexibility for the installation of the doorframe.

Figure 9:
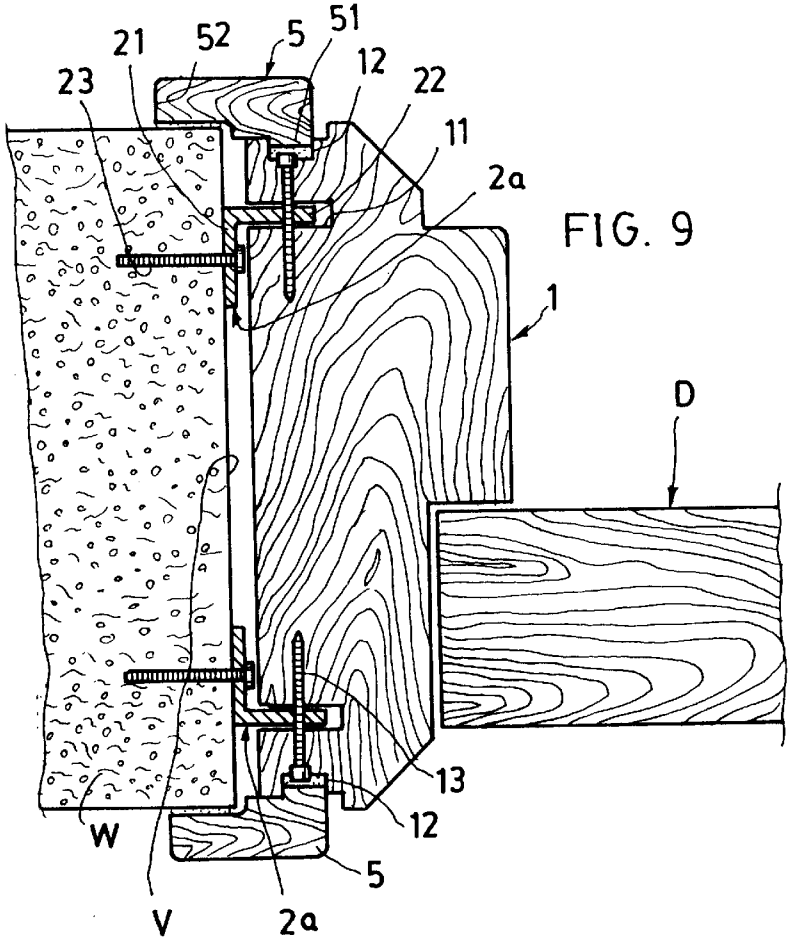
FIG. 9 shows another preferred embodiment of the present invention.

As shown in FIG. 9, each jamb 1 is fixed on the vertical side wall V by a plurality of pairs of brackets 2*a* each bracket 2*a* formed as L shape and including: a base portion 21 fixed on the side wall V by nails or screws 23, and a plate extension 22 protruding outwardly from the base portion 21 to be perpendicular to the base portion 21, with the plate extension 22 insertable into and engageable with a back groove 11 longitudinally recessed in the jamb 1, upon embedding an embedding end portion 51 of the vertical covering plate 5 into the surface groove 12 recessed in a front or rear surface portion of the jamb 1, the vertical covering plate 5 may be provided to cover the jamb 1 and to shield an aperture A between the side wall V and the jamb of the doorframe when the bonding end portion 52 of the covering plate 5 is adhered on the construction wall W.

Figure 10:
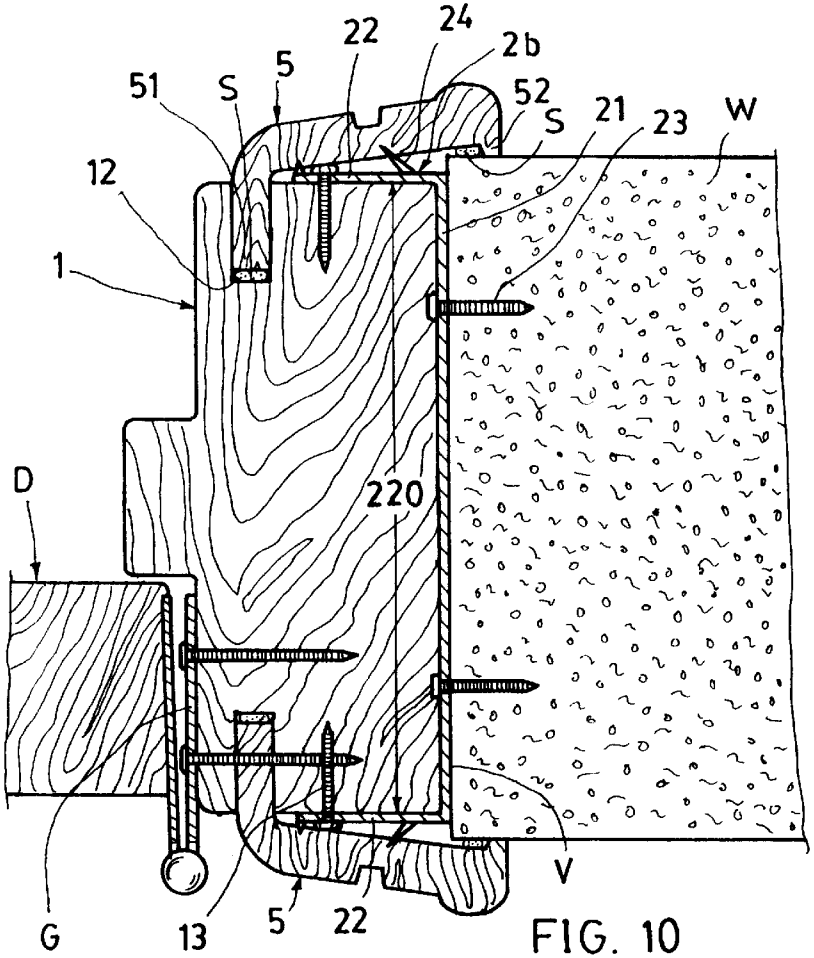
FIG. 10 shows still another preferred embodiment of the present invention.

As shown in FIG. 10, each bracket 2 is modified to be a widened bracket 2*b* including a base portion 21 secured to the vertical side wall V by screws 23, and two plate extensions 22 perpendicularly protruding outwardly from the base portion 21 to define a space 220 between the two plate extensions 22 to embed the jamb 1 into the space 220 between the two plate extensions 22 having screws 13 fastening the jamb 1 on the plate extensions 22, with a front and a rear vertical covering plate 5 embedded into a front and a rear surface groove 12 recessed in a front and a rear surface of the jamb 1 for covering the jamb and shielding an aperture A between the jamb and the side wall V.

A plurality of prongs 24 may be formed on each plate extension 22 to be pricked into the covering plate 5 as shown in FIG. 10 for firmly securing the covering plate 5 to the jamb 1.

Figure 11:
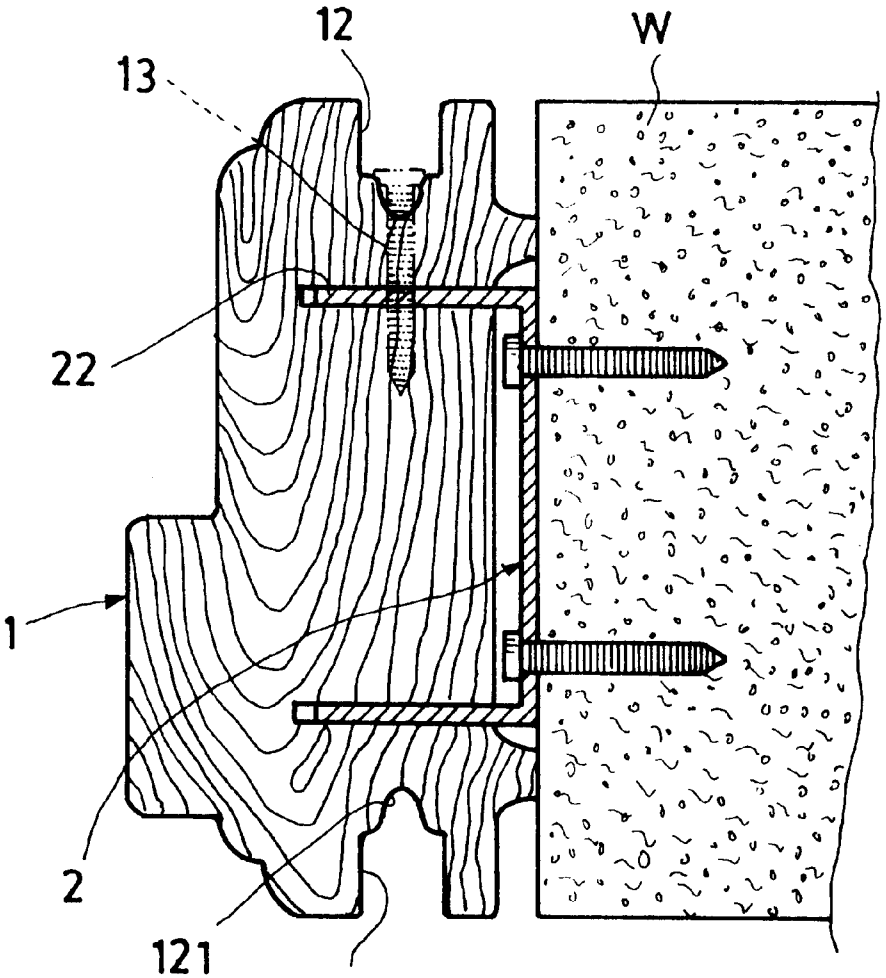
FIG. 11 shows further preferred embodiment of the present invention.

As shown in FIG. 11, the covering plate 5 may be eliminated, and the screws or nails 13 may be inserted into the groove 12 to be fastened to the plate extension 22 of the bracket 2 fixed on the wall W. Each screw or nail 13 is inserted into the jamb 1 through a guiding recess 121 recessed in each groove 12 for storing a head portion of the screw or nail in the guiding recess.

The present invention may be modified without departing from the spirit and scope of the present invention.

What is claimed is:

1. A knockdown doorframe comprising:

a plurality of brackets (2, 2*a*, 2*b*) adapted to be fixed on a right and a left vertical side wall (V) of a doorway (O) of a construction wall (W) having a horizontal top wall (H) defined at a top of the doorway (O) between the two side walls (V);

a pair of jambs (1) respectively adjustably securable on said brackets (2, 2*a*, 2*b*) to be secured on said right and left vertical side walls (V);

a lintel (4) horizontally secured to said two jambs (1) adjacent to said horizontal top wall (H) of said doorway (O) to form an inversed U-shaped doorframe;

a pair of waterproof pads (3) each cushioned on a bottom of said jamb (1); and a pair of vertical covering plates (5) each covering each said jamb (1) to shield an aperture between said jamb (1) and said vertical side wall (V); and a horizontal covering plate (5*a*) covering said lintel (4) to shield an aperture between said lintel (4) and said top wall (H).

2. A knockdown doorframe according to claim 1, wherein each said jamb (1) includes: a pair of back grooves (11) longitudinally juxtapositionally recessed in a back portion of the jamb (1), with each said back groove (11) slidably engageable with the brackets (2) pre-fixed on the vertical side wall (V); and a pair of surface grooves (12) respectively longitudinally recessed in a front surface portion and a rear surface portion of each said jamb (1) for inserting a plurality of self-tapping screws (13) through each said surface groove (12) for securing the jamb (1) with the brackets (2) fixed on the side wall (V), with each said surface groove (12) embedded with a vertical covering plate (5) therein.

3. A knockdown doorframe according to claim 2, wherein each said bracket (2) includes: a base portion (21) fixed on the vertical side wall (V) of the construction wall (W), and two plate extensions (22) protruding outwardly from opposite ends of the base portion (21) to be perpendicular to the base portion (21) to form a generally U-shaped bracket, with each said plate extension (22) insertable into and engageable with each said back groove (11) longitudinally recessed in a back portion of the jamb (1).

4. A knockdown doorframe according to claim 1, wherein said lintel (4) is horizontally secured on a top portion of each said jamb (1) and is formed with a pair of surface grooves (42) horizontally recessed in a front and a rear surface portion of the lintel (4), with each said surface groove (42) embedded with a horizontal covering plate (5*a*) therein.

5. A knockdown doorframe according to claim 2, wherein said vertical covering plate (5) includes an embedding end portion (51) insertable into and engageable with each said surface groove (12) recessed in the jamb (1), and a bonding end portion (52) opposite to the embedding end portion (51) to be firmly secured on the construction wall (W) contiguous to the vertical side wall (V).

6. A knockdown doorframe according to claim 4, wherein said horizontal covering plate (5*a*) includes an embedding end portion insertable into and engageable with each surface groove (42) recessed in the lintel (4), and a bonding end portion opposite to the embedding end portion to be firmly secured on the construction wall (W) contiguous to the horizontal top wall (H).

7. A knockdown doorframe according to claim 1, wherein said bracket (2) includes at least a packing member (20) packed between the bracket (2) and the vertical side wall (V).

8. A method for building a knockdown doorframe comprising the steps of:

(1). Determining a plurality of locations on a right and a left vertical side wall (V) within a doorway (O) of a construction wall (W) for installing two jambs (1) of a doorframe on the right and left vertical side walls (V) of the construction wall (W) corresponding to a dimension of the doorframe;

(2). Fixing a plurality of brackets (2) on the vertical side walls (V) on the locations as pre-determined on the vertical side walls;

(3). Slightly moving each said jamb (1) either horizontally or vertically on the brackets (2) by slidably engaging a plurality of back grooves (11) formed in the jamb (1) with a plurality of plate extensions (22) formed on the brackets (2) until matching with the dimension of the doorframe to be fixed within the doorway (O);

(4). Cushioning each said jamb (1) with a waterproof pad (3) on a bottom of the jamb (1);

(5). Fixing a lintel (4) on a top portion of each said jamb (1) to horizontally link the lintel (4), adjacent to a horizontal top wall (H) of the doorway, with the two jambs (1) to form an inversed U-shaped doorframe; and fastening the two jambs (1) on the vertical side walls (V) after adjustably moving the two jambs (1) on the brackets (2) on the side walls (V) to a desired position;

(6). Covering each said jamb (1) with a vertical covering plate (5) for shielding an aperture between each said jamb (1) with the vertical side wall (V); and covering the lintel (4) with a horizontal covering plate (5*a*) for shielding an aperture between the lintel (4) and the horizontal top wall (H) of the doorway (O).

9. A knockdown doorframe according to claim 1, wherein each said jamb (1) is fixed on the vertical side wall (V) by a plurality of pairs of brackets (2*a*), each said bracket (2*a*) formed as L shape and including: a base portion (21) fixed on the side wall (V), and a plate extension (22) protruding outwardly from the base portion (21) to be perpendicular to the base portion (21), with the plate extension (22) insertable into and engageable with a back groove (11) longitudinally recessed in the jamb (1), upon embedding an embedding end portion (51) of the vertical covering plate (5) into a surface groove (12) recessed in a front or rear surface portion of the jamb (1), the vertical covering plate (5) will cover the jamb (1) and shield an aperture between the side wall (V) and the jamb of the doorframe when a bonding end portion (52) opposite to said embedding end portion (51) of the covering plate (5) is adhered on the construction wall (W).

10. A knockdown doorframe according to claim 1, wherein each said bracket (2*b*) includes: a base portion (21) secured to the vertical side wall (V), and two plate extensions (22) perpendicularly protruding outwardly from the base portion (21) to define a space (220) between the two plate extensions (22) to embed the jamb (1) into the space (220) between the two plate extensions (22), with a front and a rear vertical covering plate (5) embedded into a front and a rear surface groove (12) recessed in a front and a rear surface of the jamb (1) for covering the jamb and shielding an aperture between the jamb and the side wall (V).

11. A knockdown doorframe according to claim 1, wherein said jumb (1) is formed with a groove (12) and fastened to a plate extension (22) of the bracket (2) fixed on the wall (W) by at least a screw, said groove (12) having a guiding recess (121) recessed in the groove (12) for storing a head portion of a screw inserted into the groove (12).

* * * * *